US010501910B2

(12) United States Patent
Wu et al.

(10) Patent No.: US 10,501,910 B2
(45) Date of Patent: Dec. 10, 2019

(54) SYSTEM AND METHOD FOR CONTROLLING A LIFT ASSEMBLY OF A WORK VEHICLE

(71) Applicant: CNH Industrial America, LLC, New Holland, PA (US)

(72) Inventors: Duqiang Wu, Bolingbrook, IL (US); Navneet Gulati, Naperville, IL (US); Aditya Singh, Westmont, IL (US)

(73) Assignee: CNH Industrial America LLC, New Holland, PA (US)

( * ) Notice: Subject to any disclaimer, the term of this patent is extended or adjusted under 35 U.S.C. 154(b) by 130 days.

(21) Appl. No.: 15/701,714

(22) Filed: Sep. 12, 2017

(65) Prior Publication Data

US 2019/0078288 A1 Mar. 14, 2019

(51) Int. Cl.
*E02F 3/43* (2006.01)
*E02F 3/34* (2006.01)
(Continued)

(52) U.S. Cl.
CPC ..... *E02F 3/431* (2013.01); *E02F 3/3405* (2013.01); *E02F 3/3414* (2013.01); *E02F 3/422* (2013.01); *E02F 9/2004* (2013.01)

(58) Field of Classification Search
CPC ..... E02F 3/3405; E02F 3/3414; E02F 3/422; E02F 3/431; E02F 3/432; E02F 3/434; E02F 9/2004; E02F 9/2041; E02F 9/2203
See application file for complete search history.

(56) References Cited

U.S. PATENT DOCUMENTS 3,411,647 A 11/1968 Zimmerman
4,355,946 A 10/1982 Wykhuis et al.
(Continued)

FOREIGN PATENT DOCUMENTS

CN 202543988 11/2012
EP 2947209 A1 11/2015
(Continued)

OTHER PUBLICATIONS

JPO machine translation of JP 2006-307429 (original JP document published Nov. 9, 2006) (Year: 2006).*
(Continued)

*Primary Examiner* — Behrang Badii
*Assistant Examiner* — David A Testardi
(74) *Attorney, Agent, or Firm* — Peter K. Zacharias; Patrick M. Sheldrake

(57) ABSTRACT

A method for controlling a lift assembly for a work vehicle may include receiving an input command associated with controlling movement of a loader arm of the lift assembly, and determining a travel velocity at which a reference location on the loader arm is to be moved based on the input command. In addition, the method may include determining at least one lift cylinder command and at least one control cylinder command based at least in part on the determined travel velocity and position-based inputs associated with moving the reference location along a predetermined travel path, and actively controlling an operation of a lift cylinder and a control cylinder of the lift assembly based on the lift cylinder command(s) and the control cylinder command(s), respectively, such that the reference location on the loader arm is moved along the predetermined travel path at the determined travel velocity.

21 Claims, 7 Drawing Sheets

(51) Int. Cl.
*E02F 9/20* (2006.01)
*E02F 3/42* (2006.01)

(56) References Cited

U.S. PATENT DOCUMENTS

| | | | | | |
|---|---|---|---|---|---|
| 5,160,239 | A * | 11/1992 | Allen | E02F 3/437 | 172/4.5 |
| 5,169,278 | A * | 12/1992 | Hoechst | E02F 3/3405 | 414/685 |
| 5,542,814 | A | 8/1996 | Ashcroft et al. | | |
| 5,609,464 | A | 3/1997 | Moffitt et al. | | |
| 5,701,793 | A * | 12/1997 | Gardner | E02F 3/431 | 60/327 |
| 5,737,993 | A * | 4/1998 | Cobo | E02F 3/431 | 60/327 |
| 5,875,701 | A * | 3/1999 | Cobo | E02F 3/431 | 60/327 |
| 6,115,660 | A * | 9/2000 | Berger | E02F 3/432 | 701/50 |
| 6,140,787 | A | 10/2000 | Lokhorst et al. | | |
| 6,233,511 | B1 * | 5/2001 | Berger | E02F 3/432 | 414/699 |
| 6,374,153 | B1 * | 4/2002 | Brandt | B66F 9/0655 | 414/713 |
| 6,866,466 | B2 | 3/2005 | Roan et al. | | |
| 8,521,171 | B2 | 8/2013 | Faivre | | |
| 2002/0087244 | A1 * | 7/2002 | Dix | E02F 9/2228 | 701/50 |
| 2006/0243234 | A1 | 11/2006 | Shibuya | | |
| 2006/0269386 | A1 | 11/2006 | Layko et al. | | |
| 2014/0271078 | A1 | 9/2014 | Koch | | |
| 2015/0308072 | A1 * | 10/2015 | Taylor | E02F 3/431 | 701/50 |
| 2016/0108602 | A1 * | 4/2016 | Singh | E02F 3/434 | 701/50 |
| 2016/0153165 | A1 * | 6/2016 | Singh | E02F 9/2029 | 701/50 |

FOREIGN PATENT DOCUMENTS

| | | | |
|---|---|---|---|
| EP | 3012376 | A1 | 4/2016 |
| EP | 3051032 | A2 | 8/2016 |
| JP | 2006307429 | A * | 11/2006 |
| JP | 2006307429 | A | 11/2006 |
| WO | 2015127025 | A1 | 8/2015 |

OTHER PUBLICATIONS

EPO machine translation of JP 2006-307429 (original JP document published Nov. 9, 2006) (Year: 2006).*

World Academy and Science, Engineering and Technology Bhaveshkumar P. Patel, J. M. Prajapati "Dynamics of Mini Hydraulic Backhoe Excavator A Lagrange-Euler (L-E) Approach" Dated Nov. 23, 2014 (1 page).

Gehl "Skid Loaders" Web paged dated: Aug. 30. 2017 (2 pages).

Compact Equiptment "New Holland Super Boom Compact Track Loaders" Copyright 2017 (7 Pages).

Terex Corporation "Skid Steer Loaders" Dated Aug. 30, 2017 (4 pages).

Extended European Search Report for EP Application No. 18.193.932.3 dated Feb. 14, 2019 (7 pages).

* cited by examiner

SYSTEM AND METHOD FOR CONTROLLING A LIFT ASSEMBLY OF A WORK VEHICLE

FIELD OF THE INVENTION

The present subject matter relates generally to work vehicles and, more particularly, to system and method for controlling a lift assembly for raising and/or lowering the loader arms along one or more predetermined travel paths, including one or more substantially vertical travel paths.

BACKGROUND OF THE INVENTION

Work vehicles having loader arms, such as skid steer loaders, telescopic handlers, wheel loaders, backhoe loaders, forklifts, compact track loaders and the like, are a mainstay of construction work and industry. For example, skid steer loaders typically include a pair of loader arms pivotally coupled to the vehicle's chassis that can be raised and lowered at the operator's command. The loader arms typically have an implement attached to their end, thereby allowing the implement to be moved relative to the ground as the loader arms are raised and lowered. For example, a bucket is often coupled to the loader arm, which allows the skid steer loader to be used to carry supplies or particulate matter, such as gravel, sand, or dirt, around a worksite.

Typically, each lift arm is coupled to the loader chassis at a given pivot point and is configured to be raised and lowered by a corresponding lift cylinder. As such, when the lift cylinders are extended and retracted, the loader arms may be raised and lowered, respectively, along a radial or arced path centered at the pivot point defined between the loader arms and the chassis. Such a radial lift path is often adequate for many loader applications but may not be the most desirable in applications where there is a need to alter the lift path of the loader arms to optimize performance for various tasks. For instance, to increase the rated operating capacity of the loader, it is desirable to have a substantially vertical lift path for the loader arms. As a result, manufacturers currently provide loader configurations that include complex four-bar linkages for the loader arms that allow for a substantially vertical lift path to be achieved. However, these loader configurations are restricted to lifting the loader arms along their single, pre-defined vertical lift path and, thus, the ability to alter the lift path of the loader arms for various tasks is lost.

To address this issue, U.S. Pat. No. 9,410,304 (Taylor et al), entitled "Lift Assembly for a Work Vehicle," discloses an improved lift assembly for a work vehicle that permits the loader arms to be raised and/or lowered along a plurality of different travel paths to allow for variations in the rated operating capacity, horizontal reach and/or cycle times associated with the loader arms. The mechanical configuration of the lift assembly disclosed in U.S. Pat. No. 9,410,304 represents a vast improvement over other known lift assembly configurations. However, improvements or advancements in controlling the operation of such a lift assembly, particularly in controlling the actuators or cylinders of the lift assembly, would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a method for controlling a lift assembly for a work vehicle. The lift assembly may include a loader arm extending between a forward end and a rear end and a control arm coupled between the rear end of the loader arm and a chassis of the work vehicle. The lift assembly may further include a lift cylinder configured to pivot the loader arm relative to a pivot point defined between the rear end of the loader arm and the control arm and a control cylinder configured to pivot the control arm relative to the chassis. The method may include receiving, with a computing device, an input command associated with controlling movement of the loader arm, and determining, with the computing device, a travel velocity at which a reference location on the loader arm is to be moved based on the input command. In addition, the method may include determining, with the computing device, at least one lift cylinder command and at least one control cylinder command based at least in part on the determined travel velocity and position-based inputs associated with moving the reference location along a predetermined travel path, and actively controlling, with the computing device, an operation of the lift cylinder and the control cylinder based on the at least one lift cylinder command and the at least one control cylinder command, respectively, such that the reference location on the loader arm is moved along the predetermined travel path at the determined travel velocity.

In another aspect, the present subject matter is directed to a system for controlling a lift assembly for a work vehicle. The system may include a loader arm extending between a forward end and a rear end, and a control arm extending between a first end and a second end, with the first end being coupled to a chassis of the work vehicle at a first pivot point and the second end being coupled to the rear end of the loader arm at a second pivot point. The system may also include a lift cylinder configured to pivot the loader arm about the second pivot point, a control cylinder configured to pivot the control arm about the first pivot point, and a controller including a processor and associated memory. The memory may store instructions that, when implemented by the processor, configure the controller to receive an input command associated with controlling movement of the loader arm, and determine travel velocity at which the forward end of the loader arm is to be moved based on the input command. In addition, the controller may be configured to determine at least one lift cylinder command and at least one control cylinder command based at least in part on the determined travel velocity and position-based inputs associated with moving the forward end of the loader arm along a predetermined travel path, and actively control an operation of the lift cylinder and the control cylinder based on the at least one lift cylinder command and the at least one control cylinder command, respectively, such that the forward end of the loader arm is moved along the predetermined travel path at the determined travel velocity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 6 illustrates a flow diagram of one embodiment of a control algorithm that may be used for controlling a lift assembly of a work vehicle in accordance with aspects of the present subject matter; and.

DETAILED DESCRIPTION OF THE INVENTION

Figure 1:
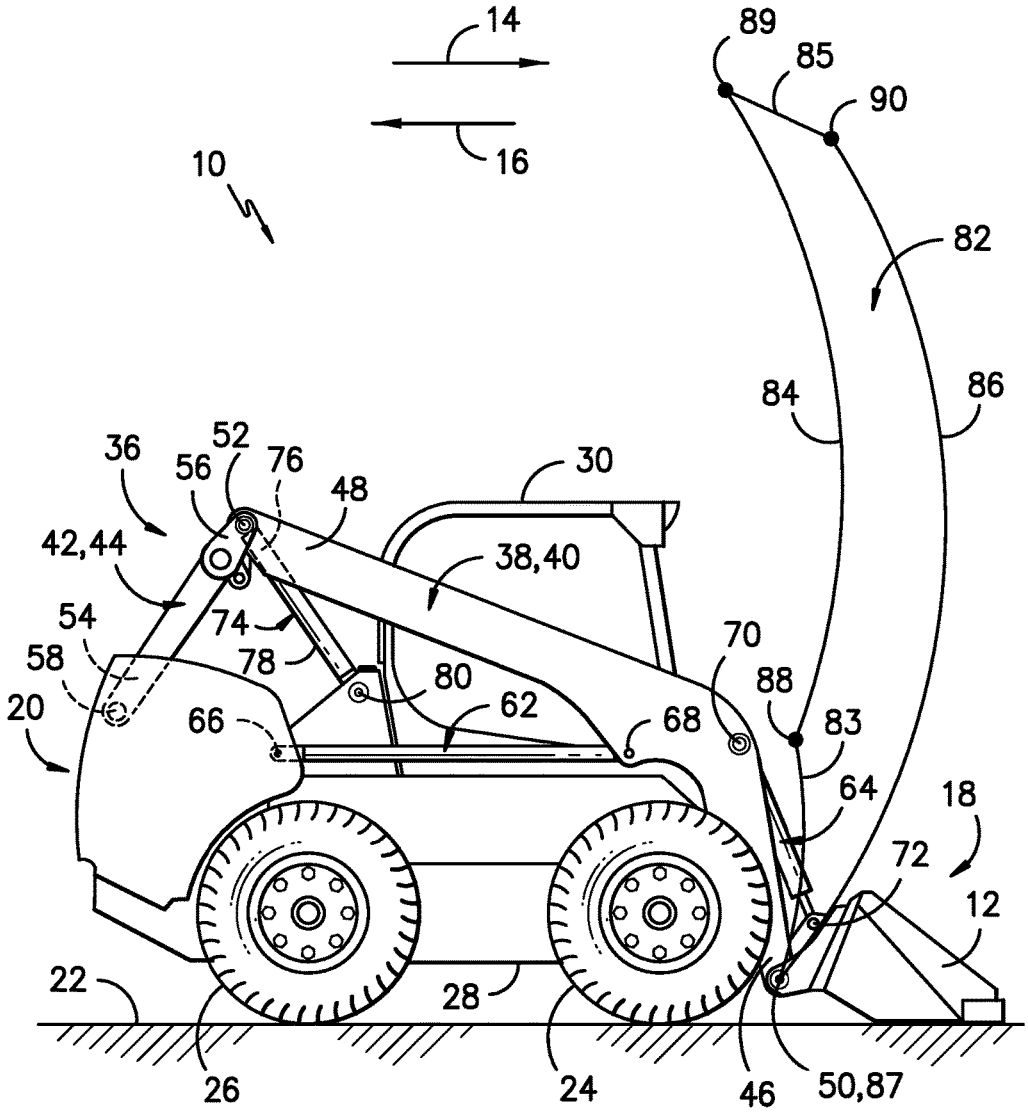
FIG. 1 illustrates a side view of one embodiment of a work vehicle in accordance with aspects of the present subject matter, particularly illustrating an implement of the work vehicle being located at its lowermost position relative to a driving surface of the vehicle.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system and method for controlling a lift assembly for a work vehicle. in several embodiments, the lift assembly may include a pair of loader arms pivotally coupled to a corresponding pair of control arms, with each control arm being pivotally coupled, in turn, to the chassis of the work vehicle. In addition, the lift assembly may include a pair of lift cylinders for raising and lowering the loader arms and a pair of control cylinders for adjusting the position of a dynamic pivot point defined between the control arms and the loader arms. Specifically, by retracting and/or extending the control cylinders, the control arms may be pivoted about a fixed pivot point defined between the control arms and the chassis, thereby adjusting the relative position of the dynamic pivot point.

In several embodiments, the operation of the lift cylinders and the control cylinders may be controlled using a trajectory-based control methodology. Specifically, as will be described below, a control model may be developed that allows control commands for the lift/control cylinders to be determined as a function of both a desired travel velocity for a reference location on the loader arms and trajectory-based position inputs associated with moving the reference location along a predetermined travel path. For instance, the trajectory-based position inputs may correspond to matrix elements representing a kinematics-determined vector field associated with the specific location(s) across which the reference location is to be moved along the predetermined travel path. By using the disclosed control methodology, the cylinder operation may be controlled in a manner that allows for improved position control for the loader arms. In addition, the trajectory-based control model may also allow for a more uniform velocity profile as the loader arms are raised or lowered along a given predetermined travel path.

Figure 2:
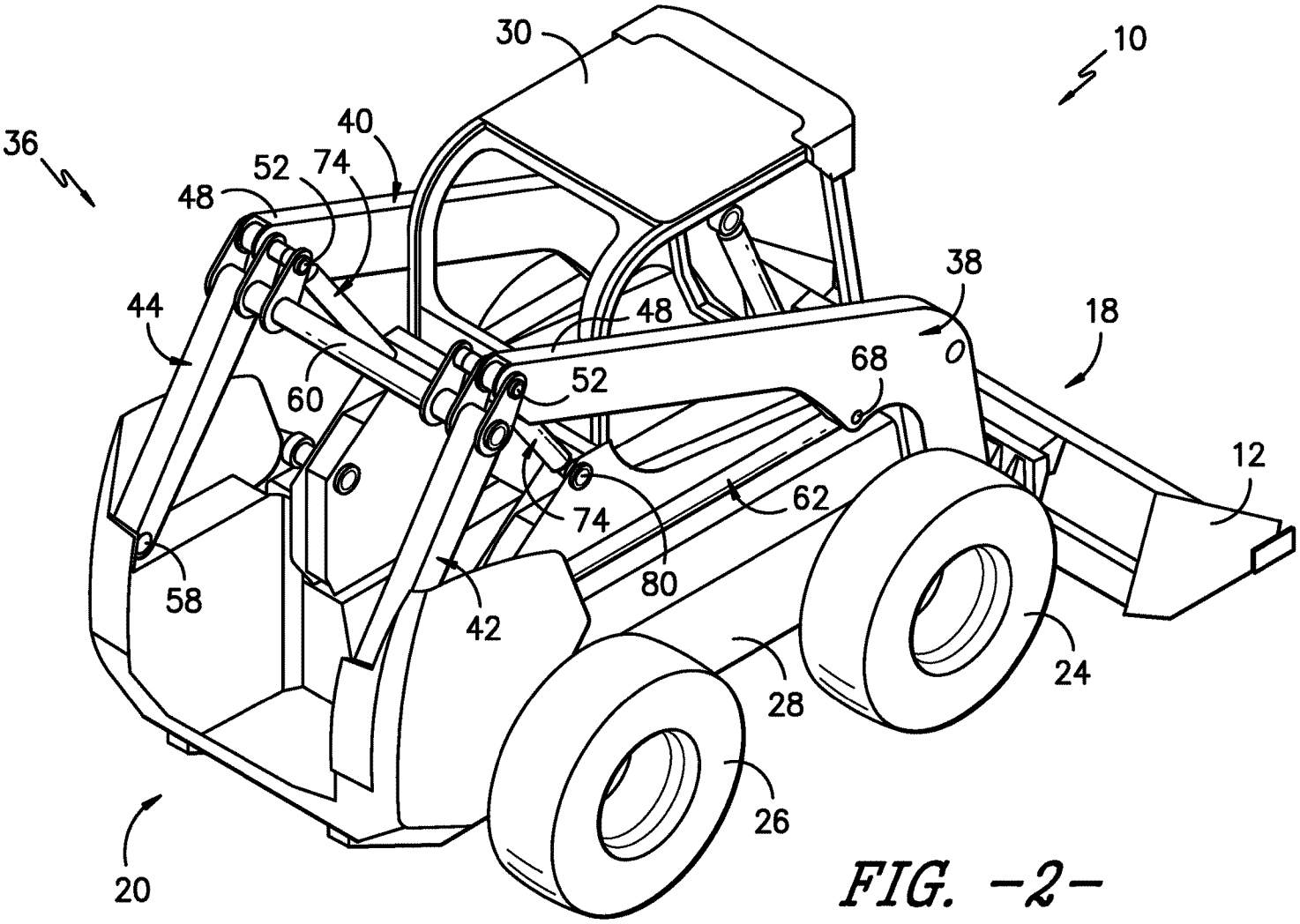
FIG. 2 illustrates a rear perspective view of the work vehicle shown in FIG. 1.
Figure 3:
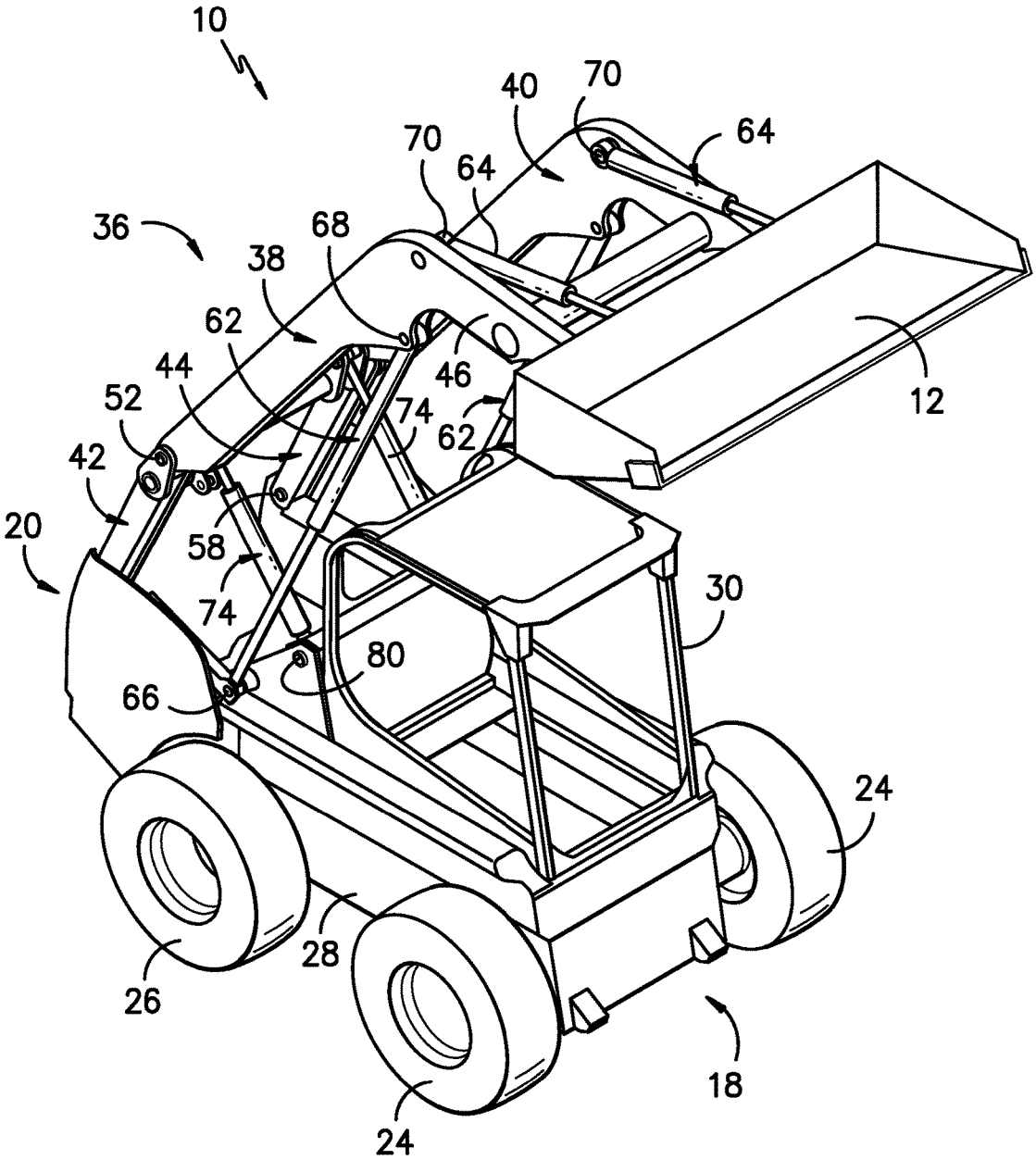
FIG. 3 illustrates a front perspective view of the work vehicle shown in FIG. 1, particularly illustrating the implement after it has been raised from its lowermost position via a lift assembly of the vehicle.

Referring now to FIGS. 1-3, one embodiment of a work vehicle 10 is illustrated in accordance with aspects of the present subject matter. Specifically, FIG. 1 illustrates a side view of the work vehicle 10, particularly illustrating an implement 12 of the work. vehicle 10 being located at its lowermost position relative to a driving surface 22 of the vehicle 10, Additionally, FIG. 2 illustrates a rear perspective view of the work vehicle 10 shown in FIG. 1 and FIG. 3 illustrates a front perspective of the work vehicle 10 after the implement 12 has been raised from its lowermost position. For purposes of description, the forward direction (indicated by arrow 14 in FIG. 1) and the reverse direction (indicated by arrow 16 in FIG. 1) will be referenced relative to a front end 18 and a rear end 20 of the work vehicle 10. Thus, for example, a first location on the work vehicle 10 may be considered to be positioned rearward of a second location on the work vehicle 10 if the first location is positioned closer to the rear end 20 of the work vehicle 10 than the second location along a reference plane extending parallel to the driving surface 22.

In the illustrated embodiment, the work vehicle 10 is configured as a skid steer loader. However, in other embodiments, the work vehicle 10 may be configured as any other suitable work vehicle known in the art, such as any other work vehicle including loader arms (e.g., telescopic handlers, wheel loaders, backhoe loaders, forklifts, compact track loaders and/or the like).

As shown, the work vehicle 10 includes a pair of front wheels 24, a pair of rear wheels 26 and a chassis 28 coupled to and supported by the wheels 24, 26. An operator's cab 30 may be supported by a portion of the chassis 28 and may house various input devices for permitting an operator to control the operation of the work vehicle 10. In addition, the work vehicle 10 may include an engine (not shown) and a hydrostatic drive unit (not shown) coupled to or otherwise supported by the chassis 28.

It should be appreciated that various components of the work vehicle 10 will be described herein as being coupled to the chassis 28. As used herein, a component may be "coupled to" the chassis 28 by being directly coupled to a component of the chassis 28 or by being indirectly coupled to a component of the chassis 28 (e.g., via a secondary component).

Moreover, as shown in FIGS. 1-3, the work vehicle 10 may also include a lift assembly 36 for raising and lowering the implement 12 (e.g., a bucket, fork, blade and/or the like) relative to the driving surface 22 of the vehicle 10. In several embodiments, the lift assembly 36 may include a pair of loader arms (e.g., a first loader arm 38 and a second loader arm 40) pivotally coupled to the implement 12 and a corresponding pair of control arms (e.g., a first control arm 42 and a second control arm 44) pivotally coupled between the loader arms 38, 40 and the chassis 28. Specifically, as shown in FIG. 1, the loader arms 38, 40 may each be configured to extend lengthwise between a forward end 46 and an aft end 48, with the forward end 46 of each loader arm 38, 40 being pivotally coupled to the implement 12 at a forward pivot point 50 and the aft end 48 of each loader arm 38, 40 being pivotally coupled to its corresponding control arm 42, 44 at a dynamic rear pivot point 52. Similarly, each control arm 42, 44 may extend between a first end 54 and a second end 56, with the first end 54 being pivotally coupled to the chassis 28 at a fixed pivot point 58 and the second end 56 being pivotally coupled to the aft end 48 of the corresponding loader arm 38, 40 at the dynamic pivot point 52.

As particularly shown in FIG. 2, in several embodiments, a connector arm 60 may be configured to extend perpendicularly between the control arms 42, 44 in order to secure the control arms 42, 44 to one another. For example, in one embodiment, the connector arm 60 may have a tube-like configuration and may be configured to be inserted through corresponding openings (not shown) defined in the control arms 42, 44. In such an embodiment, the connector arm 60 may be secured. within the openings (e.g., by welding the portions of the connector arm 60 extending through the openings to the control arms 44, 44) in order to form a frame assembly comprised of the control arms 42, 44 and the connector arm 60. By, securing the control arms 42, 44 together via the connector arm 60, it can be ensured that the control arms 42, 44 are pivoted simultaneously about the fixed pivot point 58 as the loader arms 38, 40 are being raised and/or lowered.

In addition, the lift assembly 36 may also include a pair of hydraulic lift cylinders 62 coupled between the chassis 28 and the loader arms 38, 40 and a pair of hydraulic tilt cylinders 64 coupled between the loader arms 38, 40 and the implement 12. For example, as shown in the illustrated embodiment, each lift cylinder 62 may be pivotally coupled to the chassis at a lift pivot point 66 and may extend outwardly therefrom so to be coupled to its corresponding loader arm 38, 40 at an intermediate attachment location 68 defined between the forward and aft ends 46, 48 of each loader arm 38, 40. Similarly, each tilt cylinder 68 may be coupled to its corresponding loader arm 38, 40 at a first attachment location 70 and may extend outwardly therefrom so as to be coupled to the implement 12 at a second attachment location 72.

It should be readily understood by those of ordinary skill in the art that lift and tilt cylinders 62, 64 may be utilized to allow the implement 12 to be raised/lowered and/or pivoted relative to the driving surface 22 of the work vehicle 10. For example, the lift cylinders 62 may be extended and retracted in order to pivot the loader arms 38, 40 upward and downwards, respectively, about the dynamic pivot point 52, thereby at least partially controlling the vertical positioning of the implement 12 relative to the driving surface 22. Similarly, the tilt cylinders 64 may be extended and retracted in order to pivot the implement 12 relative to the loader arms 38, 40 about the forward pivot point 50, thereby controlling the tilt angle or orientation of the implement 12 relative to the driving surface 22.

Moreover, in several embodiments, the lift assembly 36 may also include a pair of control cylinders 74 for adjusting the relative location of the dynamic pivot point 52 by pivoting the control arms 42, 44 relative to the chassis 28 about the fixed pivot point 58, thereby allowing for the travel path of the loader arms 38, 40 to be dynamically adjusted as the implement 12 is being raised and/or lowered relative to the drive surface 22. Specifically, as shown in the illustrated embodiment, the control cylinders 74 may each be configured to extend between a top end 76 and a bottom end 78, with the top end 76 of each control cylinder 74 being pivotally coupled to its corresponding control arm 42, 44 at the dynamic pivot point 52 and the bottom end 78 being pivotally coupled to the vehicle's chassis 28 at a control pivot point 80. Alternatively, the top end 76 of each control cylinder 74 may be coupled to the corresponding control arm 42, 44 at any other suitable location along the arm's length, such as at a location between the dynamic pivot point 52. and the fixed pivot point 58. Regardless, the control cylinders 74 may be extended and retracted in order to adjust the location of the dynamic pivot point 52 in a counter-clockwise direction or a clockwise direction, respectively, about the fixed pivot point 58. Thus, by controlling the actuation or stroke length of the control cylinders 74, the loader arms 38, 40 may be raised and/or lowered along any number of different travel paths as the lift cylinders 62 as are used to adjust the position of the implernent 12 relative to the driving surface 22.

For example, FIG. 1 illustrates a bounded travel area 82 defining the potential area across which the forward pivot point 50 may be moved using the disclosed lift assembly 36. Specifically, as shown in FIG. 1, the travel area 82 is defined by a first boundary line 83, a second boundary line 84, a third boundary line 85 and a fourth boundary line 86. The first and third boundary lines 83, 85 generally define the range of movement for the loader arms 38, 40 at the forward pivot point 50 when the control cylinders 74 are being actuated while the lift cylinders 62 are maintained at either their fully retracted position or their fully extended position. For example, when the forward pivot point 50 is located at the lowermost position within the bounded travel area 82 (i.e., at point 87), the forward pivot point 50 may be moved along the first boundary line 83 to point 88 by simply actuating the control cylinders 74 from a fully retracted position (at point 87) to a fully extended position (at point 88) while maintaining the lift cylinders 62 at their fully retracted position. Similarly, the forward pivot point 50 may be moved along the third boundary line 85 from point 89 to point 90 by simply actuating the control cylinders 74 from a fully extended position (at point 89) to a fully retracted position (at point 90) while maintaining the lift cylinders 62 at their fully extended position.

Moreover, the second and fourth boundary lines 84, 86 generally define the range of movement for the loader arms 38, 40 at the forward pivot point 50 when the lift cylinders 62 are being actuated while the control cylinders 74 are maintained in either their fully extended position or their fully retracted position. For example, to move the forward pivot point 50 from point 88 to point 89, the lift cylinders 62 may be actuated from a fully retracted position (at point 88) to a fully extended position (at point 89) while maintaining the control cylinders 74 at their fully extended position. Similarly, to move the forward pivot point 50 from point 87 to point 90, the lift cylinders 62 may be actuated from a fully retracted position (at point 87) to a fully extended position (at point 90) while maintaining the control cylinders 74 at their fully retracted position. As such, it should be readily understood that, to move the forward pivot point 50 from the lowermost position defined within the bounded travel area 82 (i.e., at point 87) to any other location on or within such area 82, each control cylinder 74 may be either initially maintained at its fully retracted position (e.g., to raise the forward pivot point 50 along the fourth boundary line 86) or initially extended outwardly from its fully retracted position (e.g., to initially move the forward pivot point 50 to any location rearward of the fourth boundary line 86).

It should be appreciated that, in several embodiments, the positioning of the control arms 42, 44 relative to the loader arms 38, 40 and/or the relative positioning of the various pivot points 52, 58, 66, 30 may be selected such that the desired travel area 82 is defined for the loader arms 38, 40 at the forward pivot point 50. For example, as shown in the illustrated embodiment, the location of the fixed pivot point 58 may be selected such that the pivot point 58 is positioned rearward of and vertically below the dynamic pivot point 52 when the control cylinders 74 are at their fully retracted positions. As such, each control arm 42, 44 may be configured to be angled both forward and upward from its first end 54 to its second end 56 when the control cylinders 74 are at their fully retracted positions. Additionally, in one embodiment, the location of the fixed pivot point 58 may be selected such that the pivot point 58 is still positioned rearward of the dynamic pivot point 52 even when the control cylinders 74 are at their fully extended positions. Moreover, in several embodiments, the location of the control pivot point 80 for each control cylinder 74 may be selected such that the pivot point 80 is located both vertically above and forward of the lift pivot point 66 for each lift cylinder 62. However, it should be appreciated that, in alternative embodiments, the positioning of the control arms 42, 44 relative to the loader arms 38, 40 and/or the relative positioning of the various pivot points 52, 58, 66, 80 may be adjusted to provide any other suitable configuration that allows for the loader arms 38, 40 to be raised and/or lowered along a plurality of different travel paths in a manner consistent with the disclosure provided herein.

Figure 4:
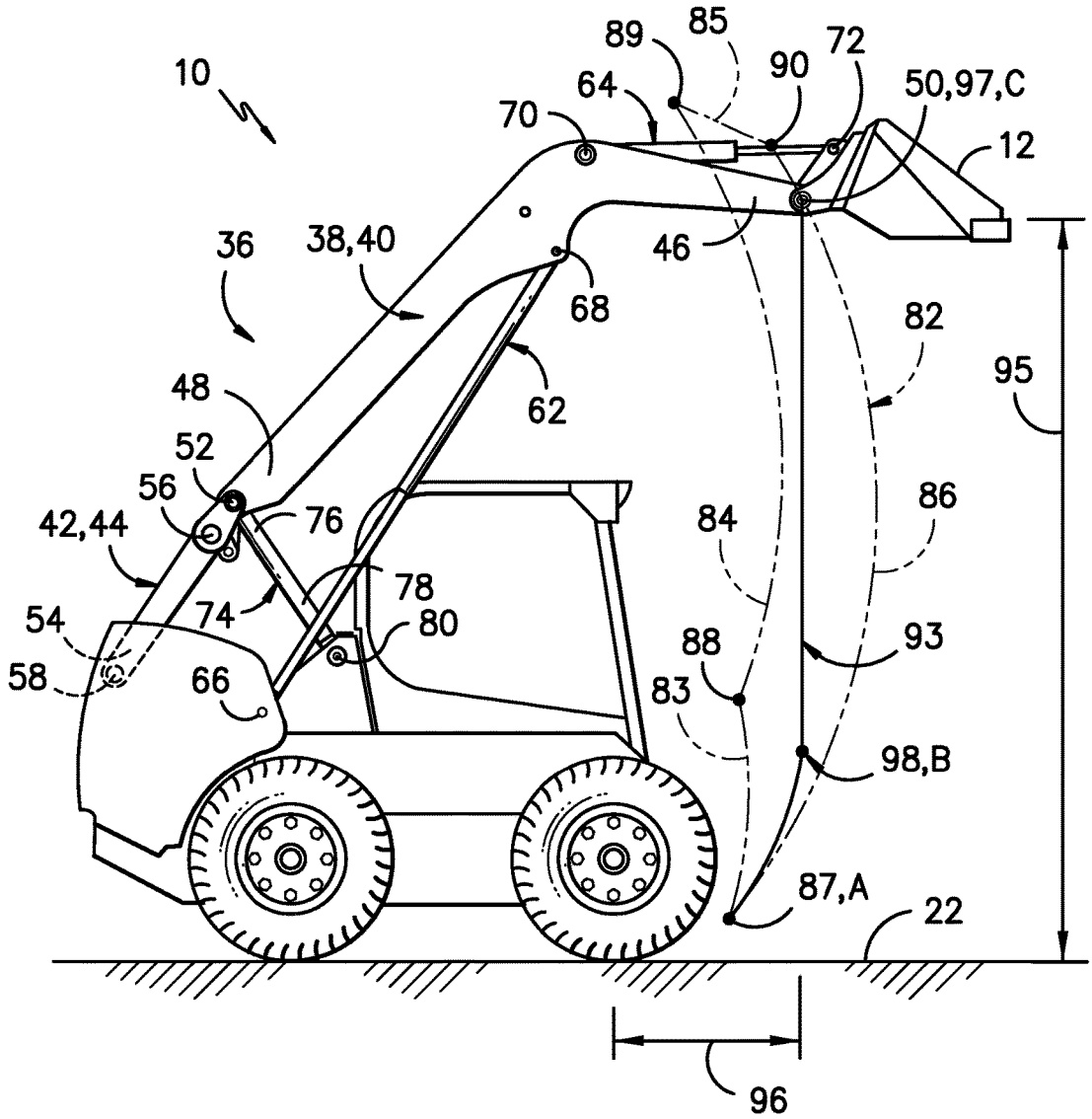
FIG. 4 illustrates a side view of the work vehicle shown in FIG. 1 with the implement being raised relative to the vehicle's driving surface to a first location, particularly illustrating a suitable travel path that may be used to raise the implement to the first location in accordance with aspects of the present subject matter.

Moreover, given the bounded travel area 82 shown in FIG. 1, one of ordinary skill in the art should readily appreciate that any number of different travel paths may be achieved within such area 82 by selectively actuating the lift cylinders 62 and the control cylinders 74 as the loader arms 38, 40 are being raised and/or lowered relative to the driving surface 22. For example, as shown in FIG. 4, it may be desirable for the implement 12 to be raised to a given height 95 above the vehicle's driving surface 22 (e.g., such that the forward pivot point 50 is located at point 97). In such instance, the loader arms 38, 40 may be directed along a given travel path 93 as the forward pivot point 50 is moved between point 87 and point 97. For example, as shown in FIG. 4, in one embodiment, the implement 12 may be raised initially along a substantially arced or curved travel path between point 87 and an intermediate point 98 prior to being raised along a substantially vertical travel path between points 98 and 97. For purposes of description, points 87, 98, and 97 will also be described herein as locations A, B, and C, respectively, such that the forward pivot point 50 is raised along travel path A-B-C from point 87 to point 97.

It should be appreciated that the travel path 93 shown in FIG. 4 is simply illustrated to provide one example of a suitable travel path that may be achieved using the disclosed lift assembly 36. However, one of ordinary skill in the art should readily understand that any number of different travel paths may be defined within the bounded travel area 82 by altering the manner in which the control cylinders 74 and the lift cylinders 62 are actuated as the implement 12 is being raised and/or lowered relative to the driving surface 22. In addition, it should be appreciated that, as an alternative to the forward pivot point 50, the bounded travel area 82 for the loader arms 38, 40 may be defined relative to any other suitable reference point or location along each loader arm 38, 40.

It should also be appreciated that, by adjusting one or more parameters associated with the lift cylinders 62 and/or the control cylinders 74 and/or by adjusting the relative positioning of the various pivot points 52, 58, 66, 80, the shape and/or size of bounded travel area 82 may be varied significantly. For instance, in a particular embodiment, the bounded travel area 82 may be expanded or shifted rearward such that the forward pivot point 50 may be moved along an absolute straight vertical travel path from the lowermost position 87.

Additionally, it should be appreciated that, although the work vehicle 10 shown in FIGS. 1-4 has been described herein as including a pair of control cylinders 74 and a pair of lift cylinders 62, the work vehicle 10 may, instead, include any number of control cylinders 74 and lift cylinders 62. For instance, in one embodiment, the work vehicle 10 may only include a single control cylinder 74 and a single lift cylinder 62 for controlling the movement of the loader arms 38, 40. Alternatively, the work vehicle 10 may include a single control cylinder 74 together with a pair of lift cylinders 62 for controlling the movement of the loader arms 38, 40 or vice versa.

Figure 5:
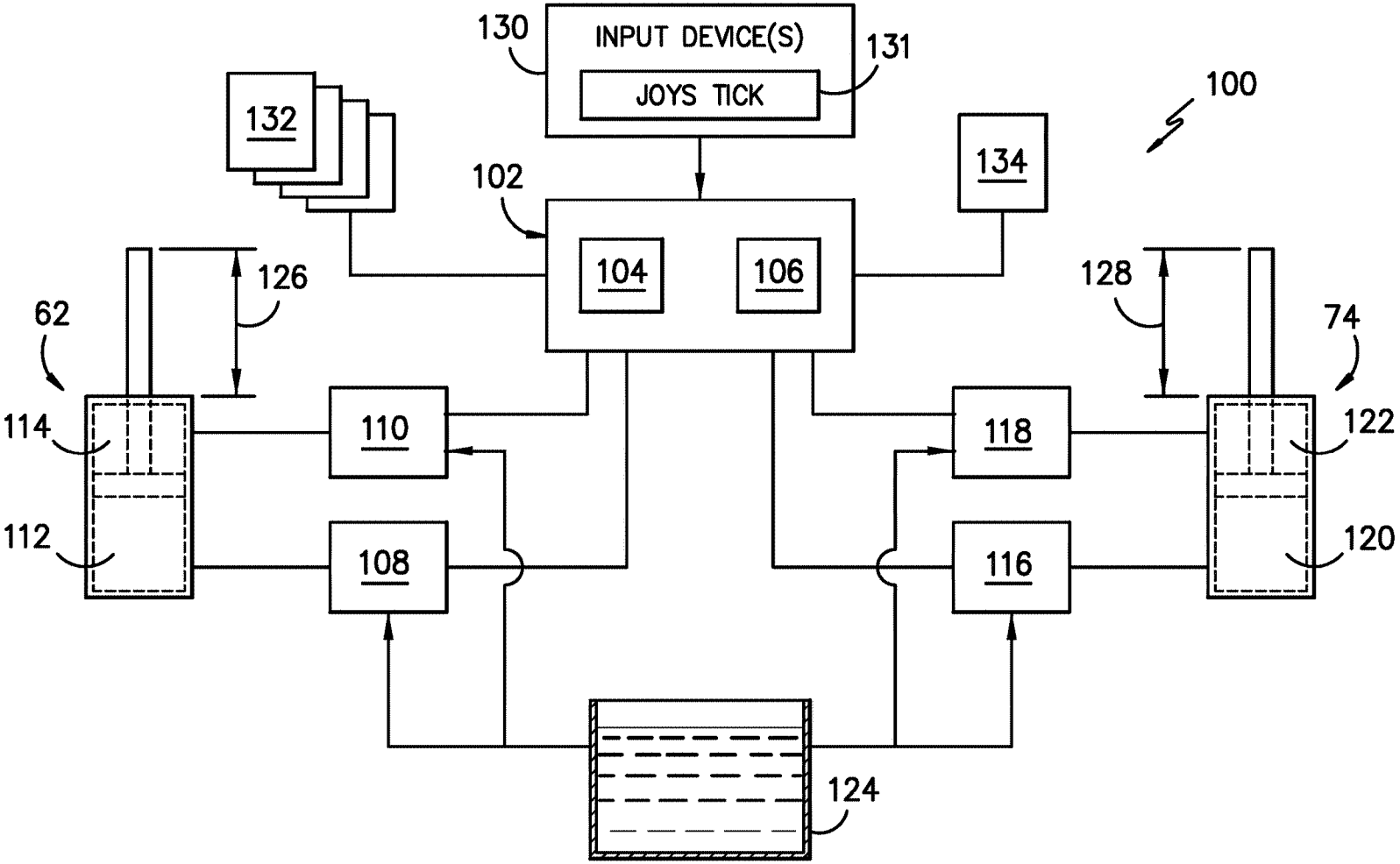
FIG. 5 illustrates a schematic diagram of one embodiment of a control system for controlling a lift assembly of a work vehicle in accordance with aspects of the present subject matter.

Referring now to FIG. 5, a schematic diagram of one embodiment of a control system 100 for controlling the disclosed lift assembly 36 is illustrated in accordance with aspects of the present subject matter. In general, the system 100 will be described herein with reference to the work vehicle 10 and lift assembly 36 described above with reference to FIGS. 1-4. However, it should be appreciated by those of ordinary skill in the art that the disclosed system 100 may generally be utilized with work vehicles 10 having any another suitable vehicle configuration and/or any other suitable lift assembly configuration consistent with the disclosure provided herein.

As shown, the control system 100 may generally include a controller 102 configured to electronically control the operation of one or more components of the work vehicle 10, such as the various hydraulic components of the work vehicle 10 (e.g., the lift cylinders 62, the control cylinders 74 and/or the tilt cylinders 64). In general, the controller 102 may comprise any suitable processor-based device known in the art, such as a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as by performing one or more of the aspects of the control algorithm 200 described below with reference to FIG. 6 and/or by performing one or more aspect of the method 300 described below with reference to FIG. 7. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

In several embodiments, the controller 102 may be configured to be coupled to suitable components for controlling the operation of the various cylinders 62, 64, 74 of the work vehicle 10. For example, as shown in FIG. 5, the controller 102 may be communicatively coupled to suitable valves 108, 110 (e.g., solenoid-activated valves) configured to control the supply of hydraulic fluid to each lift cylinder 62 (only one of which is shown in FIG. 5). Specifically, as shown in the illustrated embodiment, the system 100 may include a first lift valve 108 for regulating the supply of hydraulic fluid to a cap end 112 of each lift cylinder 62. In addition, the system 100 may include a second lift valve 110 for regulating the supply of hydraulic fluid to a rod end 114 of each lift cylinder 62. Moreover, the controller 102 may be communicatively coupled to suitable valves 116, 118 (e.g., solenoid-activated valves) configured to regulate the supply of hydraulic fluid to each control cylinder 74 (only one of which is shown in FIG. 5). For example, as shown in the illustrated embodiment, the system 100 may include a first control valve 116 for regulating the supply of hydraulic fluid to a cap end 120 of each control cylinder 74 and a second control valve 118 for regulating the supply of hydraulic fluid to a rod end 122 of each control cylinder 74. Although not shown, it should be appreciated that the controller 102 may be similarly coupled to suitable valves for controlling the supply of hydraulic fluid to each tilt cylinder 64.

During operation, hydraulic fluid may be transmitted to the PRVs 108, 110, 116, 118 from a fluid tank 124 mounted on and/or within the work vehicle 10 (e.g., via a pump (not shown)). The controller 102 may then be configured to control the operation of each valve 108, 110, 116, 118 in order to control the flow of hydraulic fluid supplied to each of the cylinders 62, 74. For instance, the controller 102 may be configured to transmit suitable control commands to the lift valves 108, 110 in order to regulate the flow of hydraulic fluid supplied to the cap and rod ends 112, 114 of each lift cylinder 62, thereby allowing for control of a stroke length 126 of the piston rod associated with each cylinder 62. Of course, similar control commands may be transmitted from the controller 102 to the control valves 116, 118 in order to control a stroke length 128 of the control cylinders 74. Thus, by carefully controlling the actuation or stroke length 126, 128 of the lift and control cylinders 62, 74, the controller 102 may, in turn, be configured to automatically control the manner in which the loader arms 38, 40 are raised and lowered relative to the vehicle's driving surface 22, thereby allowing the controller 102 to control the travel path along which the loader arms 38, 40 are moved, as desired.

Additionally, as shown in FIG. 5, the controller 102 may be communicatively coupled to one or more input devices 130 for providing operator inputs to the controller 102. Such input device(s) 130 may generally correspond to any suitable input device(s) (e.g., a control panel, one or more buttons, levers, joysticks and/or the like) housed within the operator's cab 30 that allows for operator inputs to be provided to the controller 102. For example, in a particular embodiment, the input device(s) 130 may include a joystick 131 and/or any other input device(s) that allows for the operator to transmit suitable operator inputs for controlling the position and/or movement of the loader arms 38, 40 and/or implement 12. For instance, the operator may be allowed to move the joystick 131 forward or backward to indicate his/her desire to raise or lower, respectively, the loader arms 38, 40 relative to the ground. In addition to indicating a desired travel direction for the loader arms 38, 40 (e.g., raising or lowering), the degree to which the joystick 131 is moved forward or backwards relative to its neutral position may also allow the operator to provide an input to the controller 102 associated with the desired travel velocity for the loader arms 38, 40. For instance, the degree to which the joystick 131 is moved forward or backwards relative to its neutral position may provide a proportional speed command to the controller 102 for controlling the speed at which the loader arms 38, 40 are moved.

Moreover, in several embodiments, a plurality of pre-defined travel paths may be stored within the controller's memory 106, such as the travel path 93 shown in FIG. 4 and/or any other suitable travel path extending across a portion of the travel area 82. In such embodiments, the input device(s) 130 may also correspond to suitable buttons and/or any other input device(s) that allow for the operator to transmit a suitable operator input(s) corresponding to a selection of one of the pre-defined travel paths. Upon receipt of such input(s), the controller 102 may then transmit suitable control signals to the appropriate valves in order to control the corresponding cylinders in a manner that causes the loader arms 38, 40 to be raised and/or lowered along the selected travel path. In doing so, the operator may also provide inputs via the joystick 131 for selecting the desired travel direction and/or velocity along the pre-defined travel path. For instance, upon selection of the desired travel path, the operator may utilize the joystick 131 to indicate his/her desire for the loader arms 38, 40 to be raised or lowered along the travel path and/or the desired velocity for raising or lowering the loader arms 38, 40 along the travel path.

Moreover, as shown in FIG. 5, the controller 102 may be communicatively coupled to one or more position sensors 132 for monitoring the position(s) and/or orientation(s) of the loader arms 38, 40 and/or the control arms 42, 44. In several embodiments, the position sensor(s) 132 may be configured to monitor the degree of actuation of the lift and/or control cylinders 62, 74, which may provide an indication of the position and/or orientation of the corresponding loader arms 38, 40 and/or control arms 42, 44. For instance, the position sensor(s) 132 may correspond to one or more rotary position sensors, linear position sensors and/or the like associated with and/or coupled to the piston rod(s) or other movable components of the cylinders 62, 74 in order to monitor the travel distance of such components. In another embodiment, the position sensor(s) 122 may correspond to one or more non-contact sensors, such as one or more proximity sensors, configured to monitor the change in position of such movable components of the cylinders 62, 74. In a further embodiment, the position sensor(s) may correspond to one or more flow sensors configured to monitor the fluid into and/or out of each cylinder 62, 74, thereby providing an indication of the degree of actuation of such cylinder 62, 74 and, thus, the location of the corresponding loader arms 38, 40 and/or control arms 42, 44.

In other embodiments, the position sensor(s) 132 may correspond to any other suitable sensor(s) that is configured to provide a measurement signal associated with the position and/or orientation of the loader arms 38, 40 and/or control arms 42, 44. For example, a transmitter(s) may be coupled to a portion of one or both of the loader arms 38, 40 and/or one or both of the control arms 42, 44 that transmits a signal indicative of the height/position and/or orientation of such arm(s) 38, 40, 42, 44 to a receiver disposed at another location on the vehicle 10.

By, monitoring the position and/or orientation of the loader arms 38, 40 and/or control arms 42, 44 using the measurement signals provided by the sensor(s) 132, the controller 102 may be configured to regulate the operation of the lift and/or control cylinders 62, 74 in a manner that provides for extremely accurate control of the disclosed lift assembly 36. This may be particularly advantageous in instances in which the operator has requested that the loader arms 38, 40 be raised and/or lowered along a selected or predetermined travel path. For example, upon the receipt of an operator input selecting a given travel path, the controller 102 may verify the exact position of the loader arms 38, 40 and/or control arms 42, 44 using the sensor measurements. Thereafter, the controller 102 may automatically adjust the position of the loader arms 38, 40 and/or control arms 42, 44, if necessary, in order to properly position the loader arms relative to the selected travel path (e.g., by moving the loader arms 38, 40 and/or control arms 42, 44 such that the forward pivot point 50 is positioned on the selected travel path). Moreover, the controller 102 may be configured to continuously monitor the position of the loader arms 38, 40 and/or control arms 42, 44 as the lift and/or control cylinders 62, 74 are being actuated in order to ensure that the actual travel path taken by the loader arms 38, 40 corresponds to the selected travel path.

It should be appreciated that the controller 102 may also be communicatively coupled to any other suitable sensors for monitoring one or more operating parameters of the work vehicle 10. For example, in a particular embodiment, the controller 102 may be coupled to one or more load sensors 134 for monitoring the load weight of any external loads applied through the loader arms 38, 40 via the implement 12. Such load monitoring may assist the controller 102 in determining whether an operator-selected travel path is appropriate given the current loading conditions of the work vehicle 10. For example, if the operator selects a radial travel path for raising the implement 12 to a given height above the driving surface 22, the controller 102 may be configured to utilize the load measurements provided by the sensor(s) 134 to determine whether the operator-selected path or a different travel path should be used to maintain stability of the work vehicle 10. For instance, if the load weight exceeds a given threshold, the controller 102 may determine that a more vertical travel path should be used to raise the implement to the selected height in order to avoid vehicle tipping. In such instance, the controller 102 may be configured to automatically adjust the travel path used for the loader arms 38, 40 to the more appropriate travel path and/or automatically adjust the speed at which the loader arms 38, 40 are being moved along the travel path. In addition, or as an alternative thereto, the controller 102 may be configured to provide the operator with a notification (e.g., an audible or visual notification) that the selected travel path and/or loader arm velocity is not appropriate given the current operating conditions, Moreover, in several embodiments, the controller 102 may be configured to implement a trajectory-based control methodology for controlling the operation of the lift cylinders 62 and the control cylinders 74 when moving the loader arms 38, 40 along a predetermined travel path. For instance, for purposes of description, the trajectory-based control model will generally be described with reference to the travel path 93 shown in FIG. 4 such that the forward pivot point 50 of the loader arms 38, 40 is moved along all or a portion of path A-B-C when raising the loader arms 38, 40 relative to the ground and is moved along all or a portion of path C-B-A when lowering the loader arms 38, 40 relative to the ground. However, it should be appreciated that the disclosed control model may generally be utilized when moving the forward pivot point 50 of the loader arms 38, 40 along any suitable travel path within its associated travel area 82.

Specifically, in several embodiments, a control model may be developed that correlates the control commands for the lift and control cylinders 62, 74 to both the travel velocity of a given reference location on the loader arms 38, 40 and the associated position(s) of such reference location as it is moved along a predetermined travel path. For instance, for purposes of description, the reference location will be described as the forward pivot point 50 for the loader arms 38, 40. In such an embodiment, the control model may correlate the control commands for the lift and control cylinders 62, 74 to both the travel velocity of the forward pivot point 50 and the associated position(s) of such pivot point 50 as it is moved along a predetermined travel path. However, in other embodiments, the control model may be developed using any other suitable reference location defined relative to the loader arms 38, 40.

Specifically, in one embodiment, the control model may be expressed according to the following equation (Equation 1):

$$\begin{bmatrix} V_{CtrlCyl} \\ V_{LiftCyl} \end{bmatrix} = \begin{bmatrix} a_{11} & a_{12} \\ a_{21} & a_{22} \end{bmatrix} * \begin{bmatrix} V_{FPx} \\ V_{FPy} \end{bmatrix} \quad (1)$$

wherein, $V_{CtrlCyl}$ corresponds to the control command for the control cylinders 74, $V_{LiftCyl}$ corresponds to the control command for the lift cylinders 62, $a_{11}$, $a_{12}$, $a_{21}$, and $a_{22}$ correspond to matrix elements representing a kinematics-determined vector field associated with the specific location (s) of the forward pivot point 50 along the predetermined travel path, $V_{FPx}$ corresponds to the desired travel velocity of the forward pivot point 50 in the horizontal direction (e.g., a direction perpendicular to the direction of gravity acting on the work vehicle 10), and $V_{FPy}$ corresponds to the desired travel velocity of the forward pivot point 50 in the vertical direction (e.g., a direction parallel to the direction of gravity acting on the work vehicle 10).

It should be appreciated that the position-based matrix elements (e.g., $a_{11}$, $a_{12}$, $a_{21}$, and $a_{22}$) may generally be determined as a function of the kinematics associated with the geometry of the loader arms 38, 40 and associated control arms 42, 44 as well the predetermined travel path for the forward pivot point 50 of the loader arms 38, 40. Specifically, by knowing the geometrical configuration of the lift assembly 36, the position-based matrix elements may be determined based on the associated position(s) of the forward pivot point 50 as it is moved along the predetermined travel path.

It should also be appreciated that, in several embodiments, the desired travel velocity (e.g., $V_{FPx}$ and $V_{FPy}$) for the forward pivot point 50 may be determined as a function of the velocity or speed commands provided by the operator. For instance, as indicated above, the operator may be allowed to provide suitable, joystick commands associated with the desired velocity at which the loaders arms 38, 40 are to be moved along the predetermined travel path. In such an embodiment, the joystick-based speed commands provided by the operator may be correlated to corresponding desired travel velocities (e.g., $V_{FPx}$ and $V_{FPy}$) for the forward pivot point 50 of the loader arms 38, 40, which may then be used as inputs into the control model. For example, a look-up table may be provided that correlates the joystick-based speed commands to corresponding travel velocities for the forward pivot point 50 based on the current location of the forward pivot point 50 along the predetermined travel path.

Additionally, it should be appreciated that horizontal and vertical components of the desired travel velocity (e.g., $V_{FPx}$ and $V_{FPy}$) for the forward pivot point 50 may generally vary depending on the current location of the forward pivot point 50 along the predetermined travel path. For instance, with reference to FIG. 4, the desired travel velocity for the forward pivot point 50 may include both horizontal and vertical speed components as the forward pivot point 50 is moved along the arced travel path defined between points A and B. However, as the forward pivot point 50 is moved along the vertical travel path defined between points B and C, the desired travel velocity for the forward pivot point 50 may only include a vertical speed component. In such instance, the horizontal speed component input into Equation 1 (e.g., $V_{FPx}$) may be equal to zero.

Figure 6:
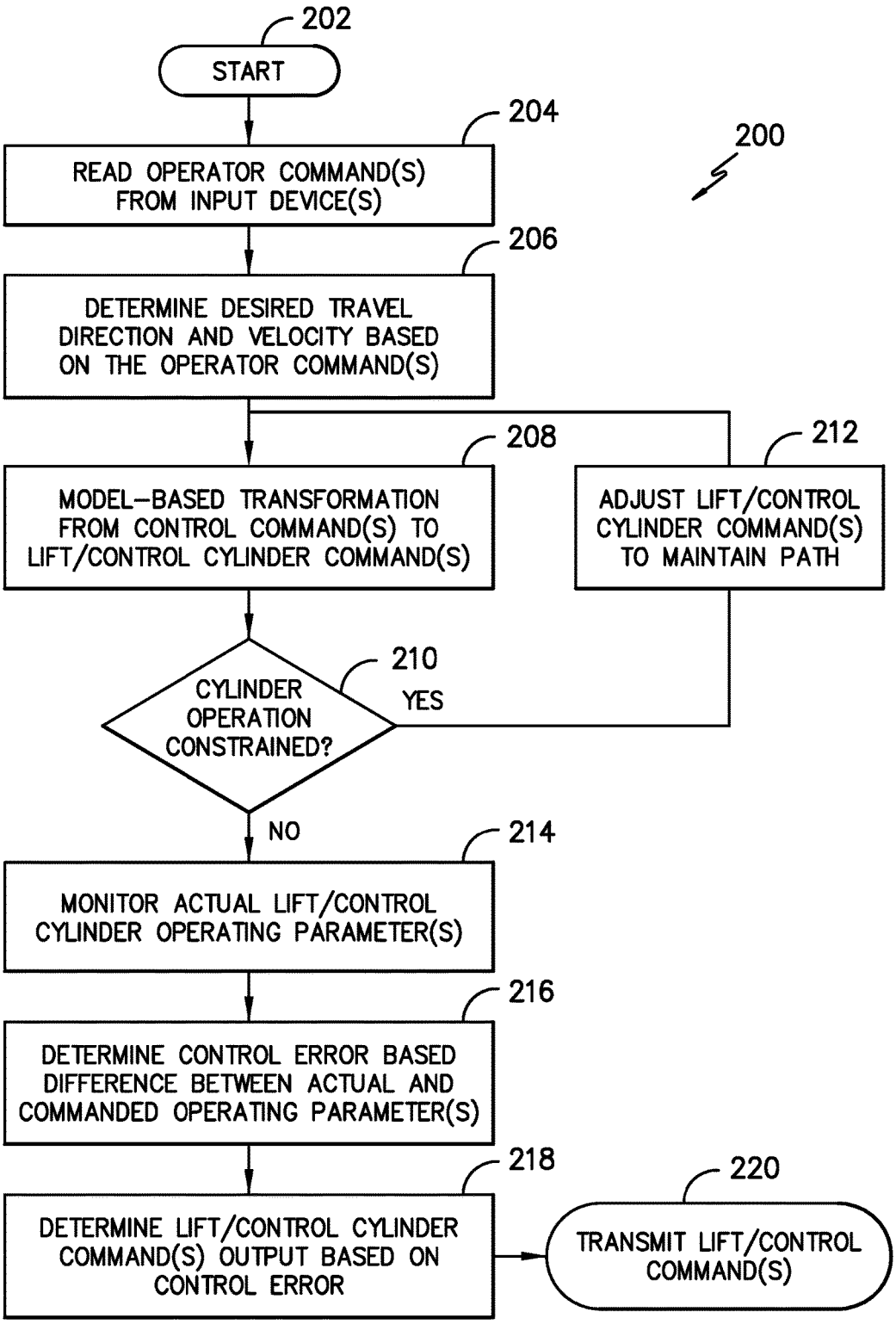

Referring now to FIG. 6, a flow diagram of one embodiment of a control algorithm 200 for implementing trajectory-based control of the movement of the loader arms 38, 40 of the disclosed lift assembly 36 is illustrated in accordance with aspects of the present subject matter. In general, the control algorithm 200 will be described with reference to the work vehicle 10, lift assembly 36 and system 100 described above with reference to FIGS. 1-5. However, it should be appreciated by those of ordinary skill in the art that the disclosed control algorithm 200 may generally be utilized to control any suitable lift assembly included within a work vehicle having any suitable configuration and/or any suitable control system. In addition, although FIG. 6 depicts steps performed in a particular order for purposes of illustration and discussion, the algorithms discussed herein are not limited to any particular order or arrangement. One skilled in the art, using the disclosures provided herein, will appreciate that various steps of the algorithms disclosed herein can be omitted, rearranged, combined, and/or adapted in various ways without deviating from the scope of the present disclosure.

As shown in FIG, 6, upon initiation of the control algorithm 200 (e.g., at 202), the controller 102 may be configured to read the operator command(s) from the input device (s) associated with controlling the movement of the loader arms 38, 40 (e.g., at 204). For example, as indicated above, a joystick 131 may be disposed within the operator's cab 30 for providing operator inputs for controlling the movement of the loader arms 38, 40. Specifically, in one embodiment, the operator may push/pull the joystick 131 forward/back to indicate the desired direction of travel for the loader arms 38, 40 (e.g., raising or lowering of the loader arms 38, 40) and may also move the joystick 131 further away from or closer to its neutral position to indicate the desired loader arm velocity for raising or lowering the loader arms 38, 40. As shown in FIG. 6, based on the control command(s) received via the input device(s), the controller 102 may, at 206, determine the desired travel direction and the desired travel velocity for the loader arms 38, 40 as requested by the operator.

Additionally, at 208, the controller 102 may execute the control algorithm 200 to perform a model-based transformation from the control command(s) received from the operator to the control command(s) needed for controlling the operation of the lift cylinders 62 and the control cylinders 74 to allow a given reference location on the loader arms 38, 40 (e.g., the forward pivot point 50) to be moved at a corresponding travel velocity along a predetermined travel path (e.g., the path 93 shown in FIG. 4). For instance, as indicated above, the controller 102 may be configured to determine a desired travel velocity (e.g., both horizontal and vertical speed components) for the forward pivot point 50 of the loader arms 38, 40 based on the velocity or speed command(s) received from the operator, The desired travel velocity may then be input into the control model along with the trajectory-based position inputs associated with moving the forward pivot point 50 along the predetermined travel path to determine corresponding control commands for controlling the operation of the lift cylinders 62 and the control cylinders 74. For example, as described above with reference to Equation 1, the desired travel velocity may be input into the control model along with the matrix elements representing the kinematics-determined vector field associated with moving the forward pivot point 50 along the predetermined travel path to determine the corresponding lift/control cylinder command(s).

Referring still to FIG. 6, at 210, the control algorithm 200 may include determining whether the operation of the control cylinders 74 and/or the lift cylinders 62 will be constrained when moving the forward pivot point 50 along the predetermined travel path at the desired travel velocity. For example, due to load-based constraints, flow-based constraints, and/or the like, one or both of the pairs of cylinders 62, 74 may be incapable of being operated in a manner that maintains the forward pivot point 50 moving at the desired travel velocity along the predetermined travel path. As shown in FIG. 6, when the operation of control cylinders 74 and/or the lift cylinders 62 will be constrained, the controller 102 may be configured to adjust the control command(s) for the control cylinders 74 and/or the lift cylinders 62 in a manner that allows the forward pivot point 50 to be maintained along the desired trajectory (e.g., at 212). For instance, the controller 102 may be configured to adjust the control command(s) for the control cylinders 74 and/or the lift cylinders 62 to allow for a reduction in the travel velocity of the forward pivot point 50 so as to maintain movement of the forward pivot point 50 along the predetermined travel path.

Additionally, when the operation of control cylinders 74 and/or the lift cylinders 62 will not be constrained, the controller 102 may, at 214, monitor one or more actual operating parameters associated with operation of the control cylinders 74 and/or the lift cylinders 62. For instance, in one embodiment, the controller 102 may be configured to monitor the position of each cylinder 74, 62 via the position sensor(s) 132 described above. In such an embodiment, the position measurements may be utilized by the controller 102 to calculate the actual velocity at which each cylinder 74, 62 is being actuated in relation to the current control command for such cylinder 74, 62. Alternatively, the controller 102 may be configured to monitor the velocity at which the cylinders 74, 62 are being actuated using any other suitable sensors, such as speed sensors, accelerometers, and/or the like.

Moreover, at 216, the controller 102 may be configured to compare the actual operating parameter(s) for the control cylinders 74 and/or the lift cylinders 62 to the commanded value of such parameter(s) to determine the current control error in controlling the operation of the cylinders 74, 62. For instance, by sensing or calculating the actual velocity at which the cylinders 74, 62 are being actuated, the controller 102 may be configured to calculate a control error between the actual cylinder velocity and the commanded cylinder velocity associated with the control commands transmitted for each cylinder 74, 62. Additionally, as shown in FIG. 6, at 218, the controller 102 may be configured to determine suitable control commands to be output for controlling the cylinders 74, 62 based on the calculated control error. For instance, in one embodiment, the controller 102 may be configured to implement a feedback-based control loop in which the control commands calculated using the control model (e.g., at control step 208) may be modified or adjusted based on a suitable gain calculated as a function of the control error.

Further, as shown in FIG. 6, at 218, the control commands output from the controller 102 may then be transmitted to suitable system components for controlling the operation the lift cylinders 62 and the control cylinders 74. For instance, as described above, the controller 102 may be configured to transmit the lift cylinder commands to the lift valves 108, 110 in order to regulate the flow of hydraulic fluid supplied to the cap and rod ends 112, 114 of each lift cylinder 62, thereby allowing for control of the stroke length 126 of the piston rod associated with each cylinder 62. Similarly, the controller 102 may be configured to transmit control cylinder commands to the control valves 116, 118 in order to to regulate the flow of hydraulic fluid supplied to the cap and rod ends 120, 122 of each control cylinder 74, thereby allowing for control of the stroke length 128 of the piston rod associated with each cylinder 74.

Figure 7:
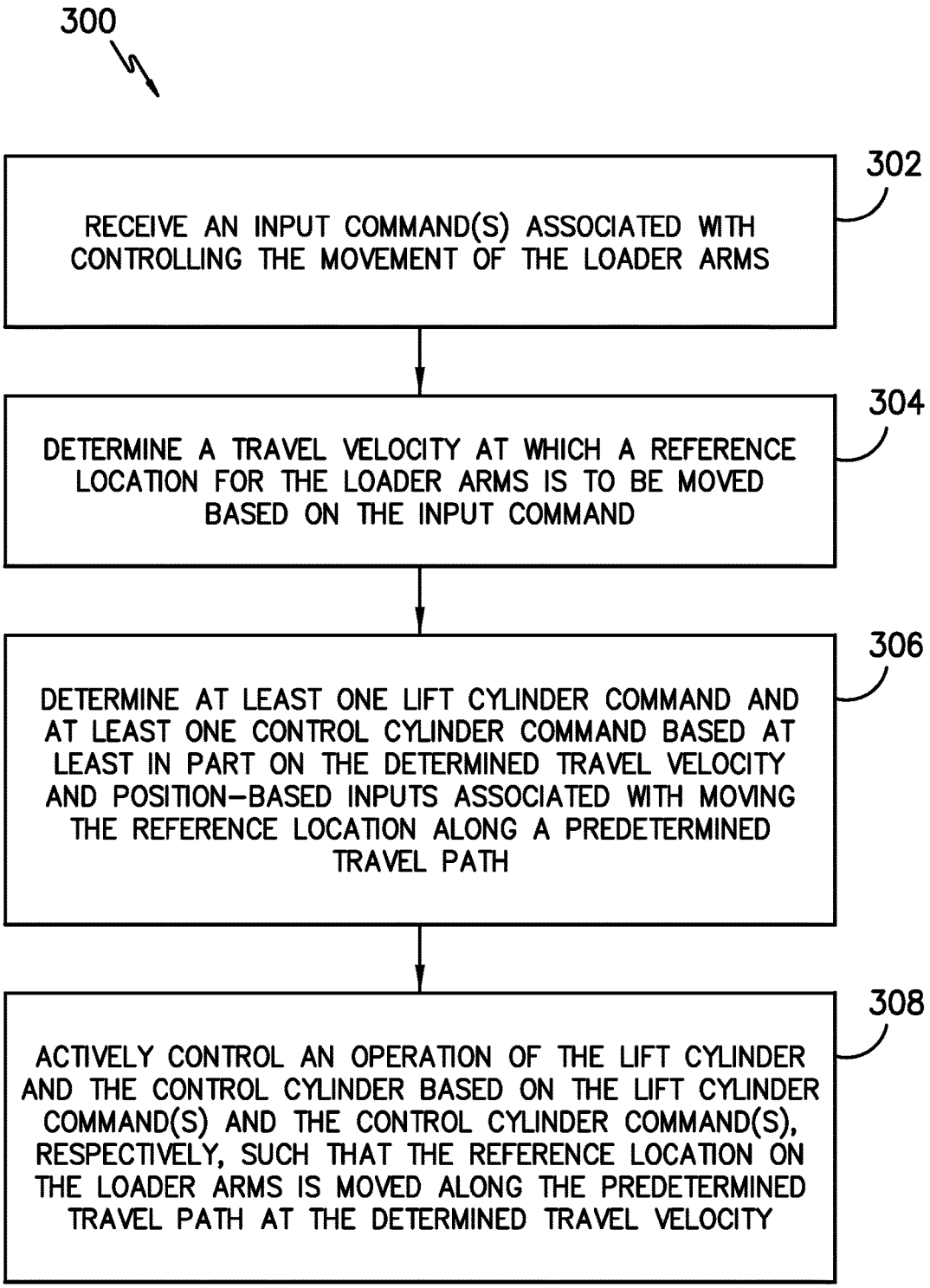
FIG. 7 illustrates a flow diagram of one embodiment of a method for controlling a lift assembly of a work vehicle in accordance with aspects of the present subject matter.

Referring now to FIG. 7, one embodiment of a method 300 for controlling a lift assembly of a work vehicle is illustrated in accordance with aspects of the present subject matter. In general, the method 300 will be described with reference to the work vehicle 10, lift assembly 36 and system 100 described above with reference to FIGS. 1-5. However, it should be appreciated by those of ordinary skill in the art that the disclosed method 300 may generally be utilized to control any suitable lift assembly included within a work vehicle having any suitable configuration and/or any suitable control system. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 7, at (302), the method 300 includes receiving an input command(s) associated with controlling the movement of the loader arms. For instance, as indicated above, the operator may be provided with a suitable input device, such as joystick 131, for inputting commands associated with moving the loader arms 38, 40, such as inputs indicating a desired direction of travel for the loader arms 38, 40 and/or inputs indicating a desired travel velocity for the loader arms 38, 40.

Additionally, at (304), the method 300 includes determining a travel velocity at which a reference location for the loader arms is to be moved based on the input command. For instance, as indicated above, the controller 102 may be configured to determine a desired travel velocity at which the forward pivot point 50 for the loader arms 38, 40 is to be moved based on the speed command(s) provided by the operator (e.g., as the joystick 131 is moved close to and/or further away from its neutral position).

Moreover, at (306), the method 300 includes determining at least one lift cylinder command and at least one control cylinder command based at least in part on the determined travel velocity and position-based inputs associated with moving the reference location along a predetermined travel path. For instance, as indicated above, the controller 102 may include a control model stored within its memory 106 that correlates the lift/control cylinder commands to both the desired travel velocity and position-based matrix elements representing a kinematics-determined vector field associated with moving the reference location on the loader arms 38, 40 along the predetermined travel path.

Referring still to FIG. 7, at 308, the method 300 may include actively controlling an operation of the lift cylinder 62 and the control cylinder 74 based on the lift cylinder command(s) and the control cylinder command(s), respectively, such that the reference location on the loader arms is moved along the predetermined travel path at the determined travel velocity. For instance, as indicated above, the controller 102 may be configured to transmit the control commands to the valve(s) 108, 110, 116, 118 associated with each cylinder 62, 74 for controlling the cylinder operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for controlling a lift assembly for a work vehicle, the lift assembly including a loader arm extending between a forward end and a rear end and a control arm coupled between the rear end of the loader arm and a chassis of the work vehicle, the lift assembly further including a lift cylinder configured to pivot the loader arm relative to a pivot point defined between the rear end of the loader arm and the control arm and a control cylinder configured to pivot the control arm relative to the chassis, the method comprising:

receiving, with a computing device, an input command associated with controlling movement of the loader arm;

determining, with the computing device, an initial travel velocity at which a reference location on the loader arm is to be moved along a predetermined travel path based on the input command;

determining, with the computing device, whether cylinder operation of at least one of the lift cylinder or the control cylinder will be constrained when moving the reference location on the loader arm along the predetermined travel path at the determined initial travel velocity;

in response to a determination that the cylinder operation of the at least one of the lift cylinder or the control cylinder will be constrained, determining, with the computing device, an adjusted travel velocity for the loader arm that will allow movement of the reference location on the loader arm to be maintained along the predetermined travel path;

determining, with the computing device, at least one lift cylinder command and at least one control cylinder command based at least in part on the adjusted travel velocity and position-based inputs associated with moving the reference location along a predetermined travel path; and actively controlling, with the computing device, an operation of the lift cylinder and the control cylinder based on the at least one lift cylinder command and the at least one control cylinder command, respectively, such that the reference location on the loader arm is moved along the predetermined travel path at the adjusted travel velocity.

2. The method of claim 1, wherein receiving the input command comprises receiving a joystick command from an operator of the work vehicle.

3. The method of claim 2, wherein the joystick command provides an indication of a desired direction of travel along the predetermined travel path and a desired travel velocity for the loader arm along the predetermined travel path.

4. The method of claim 1, wherein the reference location corresponds to a forward pivot point at which an implement of the work vehicle is pivotally coupled to the loader arm.

5. The method of claim 1, wherein determining lining the adjusted travel velocity comprises determining both a horizontal travel velocity and a vertical travel velocity at which the reference location on the loader arm is to be moved based on the input command.

6. The method of claim 5, wherein determining the at least one lift cylinder command and the at least one control cylinder command comprises determining the at least one lift cylinder command and the at least one control cylinder command based at least in part on the horizontal travel velocity, the vertical travel velocity, and the position-based inputs.

7. The method of claim 1, wherein the position-based inputs correspond to position-based matrix elements representing a kinematics-determined vector field associated with moving the reference location on the loader arm along the predetermined travel path.

8. The method of claim 7, wherein determining the at least one lift cylinder command and the at least one control cylinder command comprises determining the at least one lift cylinder command and the at least one control cylinder command based on a control model that correlates the adjusted travel velocity to the position-based matrix elements.

9. The method of claim 7, wherein the position-based matrix elements representing the kinematics-determined vector field are determined as a function of a position of the reference location on the loader arm along the predetermined travel path.

10. The method of claim 1, wherein actively controlling the operation of the lift cylinder and the control cylinder comprises:

actively controlling the operation of the lift cylinder to control pivotal motion of the loader arm about the pivot point defined between the loader arm and the control al in as the reference location on the loader arm is moved along the predetermined travel path at the adjusted travel velocity; and actively controlling the operation of the control cylinder to control pivotal motion of the control arm about an end of the control arm coupled to the chassis as the reference location on the loader arm is moved along the predetermined travel path at the adjusted travel velocity.

11. The method of claim 1, further comprising determining a control error associated with a differential between an actual operating parameter for at least one of the control cylinder or the lift cylinder and a commanded operating parameter for the at least one of the control cylinder or the lift cylinder;

wherein determining the at least one lift cylinder command and at least one control cylinder command comprises determining the at least one lift cylinder command and at least one control cylinder command based on the control error.

12. A system for controlling a lift assembly for a work vehicle, the system comprising:

a loader arm extending between a forward end and a rear end;

a control aim extending between a first end and a second end, the first end being coupled to a chassis of the work vehicle at a first pivot point and the second end being coupled to the rear end of the loader arm at a second pivot point;

a lift cylinder configured to pivot the loader arm about the second pivot point;

a control cylinder configured to pivot the control arm about the first pivot point; and a controller including a processor and associated memory, the memory storing instructions that, when implemented by the processor, configure the controller to:

receive an input command associated with controlling movement of the loader arm, determine a travel velocity at which the forward end of the loader arm is to be moved based on the input command;

determine at least one lift cylinder command and at least one control cylinder command based at least in part on the determined travel velocity and position-based inputs associated with moving the forward end of the loader al in along a predetermined travel path; and actively control an operation of the lift cylinder and the control cylinder based on the at least one lift cylinder command and the at least one control cylinder command, respectively, such that the forward end of the loader arm is moved along the predetermined travel path at the determined travel velocity;

wherein the position-based inputs correspond to position-based matrix elements representing a kinematics-determined vector field determined by the controller as a function of a position of the reference location on the loader arm along the predetermined travel path.

13. The system of claim 12, wherein the input command corresponds to a joystick command received from an operator of the work vehicle.

14. The system of claim 13, wherein the joystick command provides an indication of a desired direction of travel along the predetermined travel path and a desired travel velocity for the loader arm along the predetermined travel path.

15. The system of claim 12, wherein the controller is configured to determine both a horizontal travel velocity and a vertical travel velocity at which the forward end of the loader arm is to be moved based on the input command.

16. The system of claim 15, wherein the controller is configured to determine the at least one lift cylinder command and the at least one control cylinder command based at least in part on the horizontal travel velocity, the vertical travel velocity, and the position-based inputs.

17. The system of claim 12, wherein the controller is configured to actively control the operation of the lift cylinder to control pivotal motion of the loader arm about the second pivot point as the forward end of the loader arm is moved along the predetermined travel path at the determined travel velocity, the controller being configured to actively control the operation of the control cylinder to control pivotal motion of the control arm about the first pivot point as the forward end of the loader arm is moved along the predetermined travel path at the determined travel velocity.

18. The system of claim 12, wherein the controller is further configured to determine whether cylinder operation of at least one of the lift cylinder or the control cylinder will be constrained when moving the forward end of the loader arm along the predetermined travel path at the determined travel velocity, wherein, in response to a determination that cylinder operation of the at least one of the lift cylinder or the control cylinder will be constrained, the controller is configured to adjust one or both of the at least one lift cylinder command or the at least one control cylinder command to adjust a travel velocity of the loader arm in a manner that al lows movement of the forward end of the loader arm to be maintained along the predetermined travel path.

19. The system of claim 12, wherein the controller is further configured to determine a control error associated with a differential between an actual operating parameter for at least one of the control cylinder or the lift cylinder and a commanded operating parameter for the at least one of the control cylinder or the lift cylinder, the controller being configured to determine the at least one lift cylinder command and at least one control cylinder command based on the control error.

20. The system of claim 12, wherein the operation of the lift cylinder and the control cylinder is controlled such that the forward end of the loader arm is moved along the predetermined travel path at the determined travel velocity from an initial position defined on the predetermined travel path to a final position defined on the predetermined travel path, the position-based matrix elements being determined as a function of a current position of the reference location on the loader arm along the predetermined travel path between the initial and final positions.

21. The system of claim 12, wherein the position-based matrix elements are determined as a function of both the position of the reference location on the loader arm along the predetermined travel path and a geometrical configuration of the lift assembly.

* * * * *